United States Patent [19]

McBride, Jr.

[11] Patent Number: 4,470,559

[45] Date of Patent: Sep. 11, 1984

[54] BALL TENSION WITH IMPROVED THREADING MEANS

[75] Inventor: Edward J. McBride, Jr., Long Pond, Pa.

[73] Assignee: Qualitex, Inc., Long Pond, Pa.

[21] Appl. No.: 481,777

[22] Filed: Apr. 4, 1983

[51] Int. Cl.[3] ..... B65H 59/24; B65H 59/30

[52] U.S. Cl. ..... 242/152.1

[58] Field of Search ..... 242/152.1, 149, 151, 242/152, 147 R; 226/195

[56] References Cited

U.S. PATENT DOCUMENTS

| | | | |
|---|---|---|---|
| 3,874,613 | 4/1975 | Zollinger | 242/152.1 |
| 3,897,916 | 8/1975 | Rosen | 242/152.1 X |
| 4,030,684 | 6/1977 | Levin | 242/152.1 |
| 4,094,477 | 6/1978 | McBride, Jr. | 242/152.1 |
| 4,123,014 | 10/1978 | McCullough | 242/152.1 |

FOREIGN PATENT DOCUMENTS

| | | | |
|---|---|---|---|
| 1965 | of 1915 | United Kingdom | 242/152.1 |

OTHER PUBLICATIONS

Qualitex Textile Equipment and Accessories, Brochure of Ball Tension Devices, 6 pp.

*Primary Examiner*—Stanley N. Gilreath
*Attorney, Agent, or Firm*—Karl L. Spivak

[57] ABSTRACT

A ball type yarn tensioning device with improved threading capability is disclosed. The device includes a ball chamber having an open top. The ball chamber terminates downwardly in a bottom insert which provides a seat for a ball within the ball chamber for yarn tensioning. A cap overfits the top of the ball chamber and includes a diametrically positioned, elongated opening. A top ceramic insert of elongated rounded configuration is secured about the elongated top opening and the yarn passes therethrough. The elongated configuration facilitates threading the device by permitting a threading instrument to be inserted through the ceramic insert and the bottom insert in slanted orientation that is angularly offset from the longitudinal axis of the device.

14 Claims, 3 Drawing Figures

BALL TENSION WITH IMPROVED THREADING MEANS

FIELD OF INVENTION

The present invention relates generally to the field of ball type yarn tension devices, and more particularly, is directed to a vertical ball tension control including a cap with an elongated shaped top ceramic insert to provide improved threading means.

BACKGROUND OF THE INVENTION

Yarn tension devices have long been used in conjunction with knitting and weaving machines to provide proper tension on the yarn as the yarn is fed to the machine. The prior workers in the art have developed various types of ball type and other yarn tensioning devices for this purpose. The ball type tensioning devices usually include a vertical passageway or channel within which are positioned a plurality of balls for tensioning purposes. The vertical passageway or channel usually terminates downwardly in a ceramic insert upon which the lowermost of the balls within the channel seats for yarn tensioning purposes as the yarn is fed through the tensioning device channel. The interaction of the balls and the seat results in tensioning the yarn by squeezing the yarn against the seat as the yarn is fed through the tensioning device. McCullough, U.S. Pat. No. 4,123,014 and Levin, U.S. Pat. No. 4,030,684 are examples of prior art ball tensioning devices wherein the yarn is fed vertically. McBride, Jr., U.S. Pat. No. 4,094,477 illustrates a vertical type ball tension device wherein the yarn is tensioned as it feeds horizontally through the device.

As disclosed in the above cited patents, the prior art yarn tensioning devices generally include a housing which defines a cylindrically shaped, vertically oriented yarn passageway. The yarn passageway is downwardly defined at the lower end thereof by a ceramic yarn eye insert which provides a seat for the lowermost ball within the passageway so that the ball normally remains seated upon the insert. In the design of the horizontal yarn device, a pair of diametrically opposed bottom inserts are provided and the lowermost ball seats upon the inserts.

In the case of ball tension devices designed for use with vertical yarns, it is usual to employ a threading device, such as a latchless knitting needle for yarn threading purposes. The latchless needle can be inserted downwardly through the yarn passageway and through the yarn opening defined in the bottom ceramic insert by displacing the balls laterally as necessary to pull the yarn through the device. Threading of the prior art ball tension devices has usually presented problems because of the physical size of the balls and the restricted diameter of the ball chamber. The respective dimensions have usually rendered it impossible to thread the device in a single pass with a straight threading instrument. It was often necessary to remove the cap and sometimes the balls in order to thread the device. This was cumbersome and often resulted in caps and balls being dropped onto the floor. In most prior art designs, the vertical alignment of the top ceramic insert in the tension device cap and the bottom ceramic seat and the position and size of the intervening steel balls have prevented threading the device in a single pass.

Once the yarn has been properly threaded through the yarn tension device for feeding to a weaving, knitting or other known type of yarn employing machine, the lowermost ball will then automatically return to its seat with the yarn being fed between the ball and the seat for yarn tensioning in the designed manner. In the case of heavy yarns, for example yarns suitable for use with carpets, it is presently the practice to provide ball tension devices of similar configuration but of increased dimensions and with larger and heavier balls. The use of such heavy balls renders these presently available larger yarn tension devices relatively more difficult to thread.

SUMMARY OF THE INVENTION

The present invention relates generally to the field of yarn tensioning devices, and more particularly, is directed to a ball tension control incorporating a novel ceramic top grommet or insert to provide means to allow quick threading of a yarn through the tension device.

The ball tension control device of the present invention is conventionally molded or otherwise fabricated to include a generally cylindrical vertically oriented body with an integral mounting bracket. The vertical body defines a hollow vertical ball chamber or yarn passageway of suitable diameter and height to receive therein one or more steel balls for yarn tensioning purposes. The yarn passageway is upwardly open to facilitate adding or removing balls from the ball chamber in a conventional manner. The ball chamber terminates downwardly in a constricted bottom opening, which opening is provided preferably with a circular bottom flange. A ceramic insert of conventional design is a press fit within the constricted bottom opening and upon the bottom flange to serve as a seat for the lowermost of the steel balls. The ceramic insert is generally hollow, cylindrically shaped in configuration and defines a yarn opening for passing the yarn into the opening and through the vertical yarn passageway. The lowermost ball functions to squeeze the yarn upon a top generally rounded surface of the ceramic insert seat as the yarn passes through the insert yarn opening to the yarn passageway to thereby tension the yarn by the interaction of the ball upon the seat.

A novel cap is provided to overfit the top of the yarn passageway and is a press fit upon the top of the body. An elongated opening is formed in the top of the cap of length substantially equal to the interior diameter of the cap and of width that is less than the interior diameter of the cap. A ceramic insert or grommet of complementary configuration to the cap top opening is secured within the top opening to provide an elongated protected passageway for the running yarn at the top of the device and also to facilitate threading the tension device by employing a suitable threading instrument.

Preferably, the top ceramic insert is formed with long parallel side walls and rounded end walls which define an elongated top opening to provide a completely interiorly smooth yarn passageway for the running yarn. The inner periphery of the top insert rounded ends is substantially tangential to an extension of the inner periphery of the tension device yarn passageway or ball chamber to thereby maximize the lateral offset positioning of a threading instrument when threading the tension device. The parallel side walls of the top ceramic insert are formed of width less than the diameter of the ball chamber and less than the diameter of the smallest ball within the ball chamber. In this manner, the top ceramic insert facilitates threading of the yarn tension device due to its elongated configuration and at the same time, prevents the unwanted escape of balls upwardly through the tension device cap in the event that any upward forces imposed by the running yarn might tend to propel a ball upwardly.

The maximum lateral offset of the rounded ends of the top ceramic insert from the longitudinal axis of the ball chamber facilitates angular introduction of a threading instrument whereby the instrument can be manipulated to push the balls laterally as it is downwardly inserted through the ball chamber. In this manner, the hook of the threading instrument can be urged downwardly through the openings defined in the top insert and in the bottom grommet in a single stroke for yarn threading purposes. After the hook of the threading instrument is utilized to pull the yarn upwardly through the ball tension device, the threading instrument is then removed from association with the ball tension and the balls within the ball chamber will again resume their normal positions through the action of the forces of gravity. The laterally offset threading axis provided by the elongated top insert opening provides for a simple, quick and easily threaded ball tension device.

It is therefore an object of the present invention to provide a novel ball tension device with improved threading means.

It is another object of the present invention to provide a novel ball tension with improved threading means which comprises a vertical ball chamber with an open top and with a restricted seat at the bottom thereof, a cap overlying and partially closing the top of the ball chamber, the cap being provided with an elongated opening and a top ceramic insert secured within the opening, the ceramic insert defining a smooth elongated threading opening at the top of the ball chamber.

It is another object of the present invention to provide a novel ball tension with improved threading means comprising a vertical ball chamber, the chamber terminating downwardly in a bottom ceramic eye insert and upwardly in an open top, a plurality of balls within the vertical chamber and resting upon the bottom ceramic eye insert and a cap applied to the vertical ball chamber at the open top thereof, the cap including elongated means to provide an inclined threading path through the ball chamber, which means can accommodate a threading tool in a manner to permit the unit to be easily threaded in a single stroke.

It is another object of the present invention to provide a novel ball tension with improved threading means that is simple in design, rugged in construction and trouble-free when in use.

Other objects and a fuller understanding of the invention will be had by referring to the following description and claims of a preferred embodiment, taken in conjunction with the accompanying drawings, wherein like reference characters refer to similar parts throughout the several views and in which:

DESCRIPTION OF THE PREFERRED EMBODIMENT OF THE INVENTION

Figure 1:
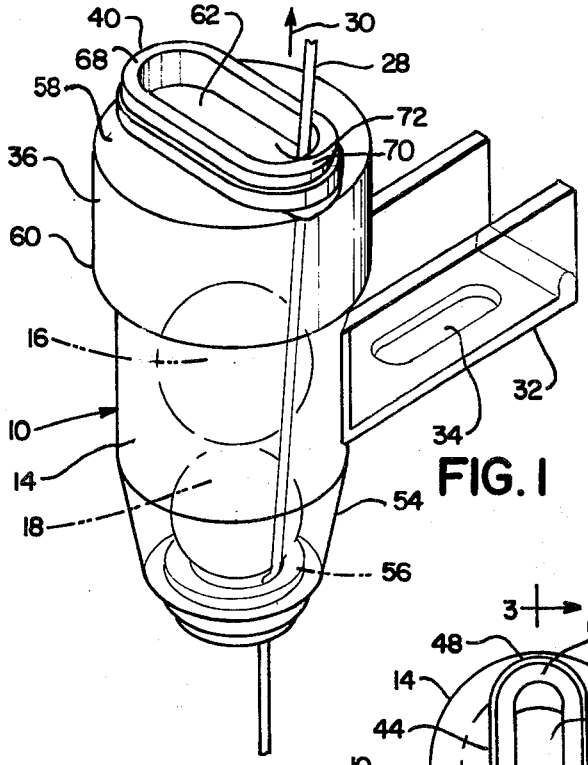
FIG. 1 is a perspective view of a ball tension with improved threading means which is constructed in accordance with the teachings of the present invention.

Although specific terms are used in the following description for the sake of clarity, these terms are intended to refer only to the particular structure of the invention selected for illustration in the drawings, and are not intended to define or limit the scope of the invention.

Referring now to the drawings, as illustrated in FIG. 1, a ball tension control device 10 is illustrated in vertical, upright position in the vertical orientation intended when the device is in use. The ball tension control 10 may be employed in known manner in conjunction with the operation of the usual types of machines with which running yarns are used, for example, knitting machines, weaving machines, and the like (all not illustrated). An integral mounting bracket 32 is provided to secure the yarn tension control to the associated machine in usual, well known manner. Preferably, an elongated mounting bracket opening 34 is provided to facilitate installation and connection to the machine, all in conventional manner well known to those skilled in the art.

The ball tension control 10 of the present invention comprises a generally cylindrical housing or body 14 which defines a vertical, generally cylindrical ball chamber or yarn passage 12 wherein a plurality of steel balls 16, 18 are maintained therewithin in vertical stacked relationship. Preferably, the ball tension device 10 is fabricated by molding of colored or clear plastic of suitable composition and strength for the application, in known manner. The vertical ball chamber 12 terminates upwardly in an open top 22 whereby balls may be either added or removed from the ball chamber 12 in a relatively easy operation at the job site. The ball chamber 12 is downwardly constricted in known manner to form a generally frusto-conical configuration 54 which terminates downwardly in a bottom step or flange 52.

A ceramic yarn eye insert 24 defines an uninterrupted bottom yarn passageway 26 therethrough and is bottomly secured within the vertical ball chamber by resting upon the bottom flange 52. If desired, the ceramic insert 24 may be cemented in place in well known manner to secure the insert 24 to the flange 52. Alternately, the ceramic insert 24 may simply be a press fit within the bottom flange 52 in known manner as necessary to prevent disassociation of the parts. Preferably, the ceramic insert 24 is formed with a top flange 56 of size and configuration to rest upon the molded plastic body at the bottom flange 52 in a relatively easy installation and includes a rounded or chambered seat 42.

The frusto-conical bottom portion 54 of the ball chamber 12 functions to guide the lowermost ball 18 toward the ceramic insert 24 in a manner whereby the ball will always normally tend to rest upon the seat 42, which seat comprises a chamfered or rounded upper portion of the ceramic yarn eye insert flange 56. Preferably, as illustrated in FIGS. 1 and 3, the lowermost ball 18 is smaller in diameter than the upper ball or balls 16 whereby the lowermost ball 18 can readily seat upon the ceramic insert 24 as the ball is guided by the conical shape of the lower frusto-conical ball chamber portion 54.

It will be appreciated that in some designs, it may be advantageous to construct the ball chamber in a cylindrical configuration with cylindrical interior walls of uniform diameter wherein the diameter of the ball chamber will be the same throughout its height. Under such circumstances, all of the balls positioned within the ball chamber would then optimally be of the same diameter and would still function in the same manner as hereinafter described. That is, the lowermost ball would still seat upon the rounded seat of the ceramic insert for yarn tensioning purposes as the yarn is run through the device. The cylindrical sidewall configuration about the periphery of the seat would tend to urge the lowermost ball towards the seat for yarn tensioning purposes during all normal periods of use.

Figure 2:
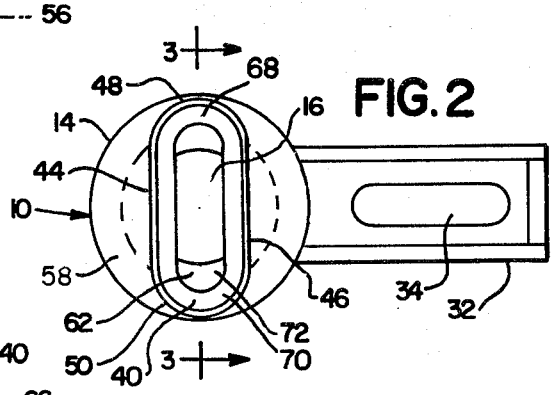
FIG. 2 is a top plan view of the ball tension illustrated in FIG. 1.
Figure 3:
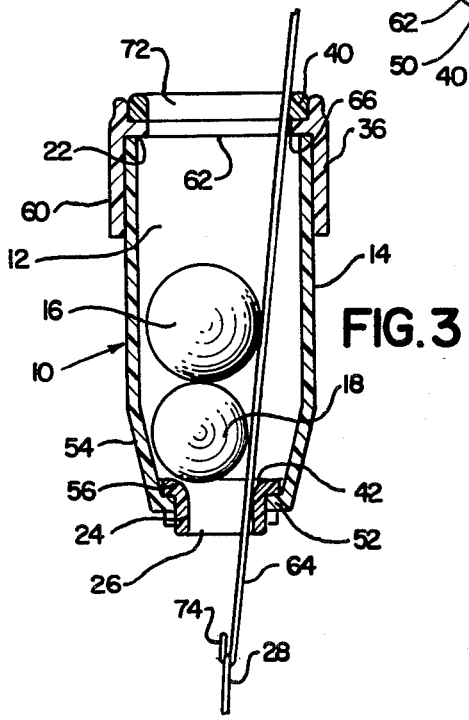
FIG. 3 is a cross-sectional view taken along line 3—3 of FIG. 2, looking in the direction of the arrows.

As best seen in FIGS. 1 and 3, a cap 36 overfits and closes the open top 22 of the ball chamber 12. The cap 36 includes a top 58 with integral, depending sidewalls 60 to frictionally engage the outer periphery of the body 14 at the open top thereof. A top opening 62 of elongated configuration is provided in the top 58 of the cap 36. The elongated configuration serves the dual purposes of passing the yarn 28 therethrough and of facilitating the angular placement of a threading tool 64 in the manner hereinafter more fully set forth. As illustrated in FIG. 2, the elongated opening 62 is formed with parallel long sides 44, 46 and smooth rounded ends 48, 50 interconnecting the sides.

The top ceramic insert 40 is formed to the same general configuration as the cap opening 62 and is secured therein in suitable manner, for example, by cementing in place. Preferably, the cap is provided with a continuous interior flange 66 about the opening 62 to provide a peripheral ledge upon which the top insert 40 can rest to thereby provide a simple but strong interconnection. As illustrated, preferably the rounded ends 68, 70 of the top ceramic insert 40 are carried laterally outwardly to the periphery of the body 14 to thereby permit as great an offset from the longitudinal axis as possible for the threading tool 64 when the device 10 is to be threaded.

The ball or balls 16, 18 employed for use with the ball tension control device 10 are preferably fabricated of hardened stainless steel of predetermined weight and predetermined diameter relative to the diameter of the ball chamber 12 and the frusto-conical lower portion 54. The total weight of the balls is selected to most advantageously apply the desired amount of tension to the yarn 28 as it passes from its source upwardly through the bottom yarn opening 26. Tension is applied by the interaction between the seat 42 of the insert 24 and the lowermost ball 18, which ball rests upon the seat and applies tension to the running yarn 28. As best seen in FIG. 1, the yarn 28 passes about the lowermost ball 18 and follows a path that may be vertical or inclined from the vertical. The yarn travels through the ball chamber 12, passes through the elongated top opening 62 and through the opening 72 defined in the top ceramic insert 40 in the direction of the arrow 30.

The diameter of the lowermost ball 18 may vary within limits defined by the diameter of the ball chamber immediately adjacent to the seat so long as the diameter of the ball 18 is sufficiently large to rest upon the ceramic seat 42 for yarn tensioning purposes. The lowermost ball 18 should be fabricated to a diameter that is sufficiently less than the diameter of the ball chamber at the smallest diameter of the frusto-conical area 54 so that the interior surface of the ball chamber adjacent to the ceramic seat 42 will sufficiently restrain lateral movements of the ball whereby the forces of gravity, acting upon the ball, will urge the lowermost ball 18 to remain seated atop the bottom ceramic insert 24. A sufficient number of upper balls 18 can be provided within the ball chamber 12 as may be desired to properly adjust the tension upon the yarn 28 at the seat.

The ball tension control device 10 of the present invention is provided with a quick threading means which incoporates the elongated opening 72 defined within the top ceramic insert 40 to permit a threading instrument to be oriented in laterally offset relationship to the longitudinal axis through the bottom ceramic insert 24 and the ball chamber 12. In this manner, a relatively thin, straight or bent, elongated threading instrument 64 having a hook 74 at one end, such as a straight or bent latchless knitting needle, may be employed for yarn threading purposes.

Referring specifically to the position of the yarn 28 illustrated in FIGS. 1 and 3, the threading instrument 64 can be applied downwardly through the top ceramic opening 72 by applying the shank of the threading tool against one of the rounded ends 68, 70 of the top ceramic insert 40 to thereby laterally offset the top of the threading instrument to as great an extent as possible. The threading instrument 64 can then be applied downwardly along the sidewalls of the body 14 and through the opening 26 defined by the lower ceramic insert 24 in a single pass by urging the ball 16 laterally and by pushing the lowermost ball 18 off of its seat with the aid of the threading instrument hook 74.

With the instrument inserted along the general path defined by the ceramic insert top and bottom openings 72, 26, the hook 74 can then engage the yarn 28 below the tension device 10 and the instrument can be drawn upwardly along the same generally angularly inclined path as illustrated. As the threading instrument 64 is withdrawn upwardly, it will function to pull the yarn 28 through the bottom yarn eye insert opening 26, through the interior of the ball chamber 12 and through the upper opening 72 which is defined by the top ceramic insert 40, thereby readily threading the device in a single pass.

After the threading instrument 64 has been withdrawn from its threading position within the lower insert opening 26 and the ball chamber 12, the lowermost ball 18 will automatically by gravity return to its position upon the seat 42 of the lower ceramic insert 24. It will be appreciated that the width of the top opening 62 as defined between the elongated, parallel sides 44, 46 will be less than the diameter of any of the balls 16, 18 inserted into the ball chamber 12 so that the balls cannot inadvertently be propelled out of the ball chamber 12 at any time when the cap 36 is in place.

Although the present invention has been described with reference to the particular embodiments herein set forth, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather only by the scope of the claims appended hereto.

What is claimed is:

1. A ball tension device with improved yarn threading means comprising a body defining a hollow ball chamber to loosely hold at least one ball, the diameter of the ball being less than the diameter of the ball chamber, the ball chamber terminating at one end in a top having an opening and at the other end in a bottom hardened insert, the bottom hardened insert defining an opening therethrough for the passage of yarn and a seat about the opening, the ball resting upon the seat for yarn tensioning purposes; and a cap overfitting the top of the ball chamber and partially closing the top opening, the cap being provided with a non-round opening for the passage of yarn therethrough, the length of the non-round opening being substantially equal to the diameter of the ball chamber and another dimension of the said non-round opening being less than the diameter of the ball;

whereby a threading instrument may be inserted through the non-round opening and the bottom insert opening of the ball chamber by laterally displacing the ball off of its said seat.

2. The ball tension device of claim 1 wherein the non-round opening is elongated in configuration.

3. The ball tension device of claim 2 wherein the non-round opening is defined by parallel, spaced long sides and rounded ends endwardly joining the long sides.

4. The ball tension device of claim 1 wherein the ball chamber has a longitudinal axis and wherein the path of the threading instrument through the ball chamber is inclined from the said axis.

5. The ball tension device of claim 1 wherein the ball chamber terminates upwardly in an open end to permit adding balls into or removing balls from the ball chamber, the diameter of the top opening being substantially equal to the diameter of the ball chamber.

6. The ball tension device of claim 5 wherein the ball chamber comprises a cylindrical upper portion and a frusto-conical shaped lower portion, the bottom hardened insert being secured at the lower end of the frusto-conical shaped lower portion.

7. The ball tension device of claim 3 and a top hardened insert positioned about the cap opening, the top hardened insert being contacted by the yarn as it passes through the device.

8. The ball tension device of claim 7 wherein the top hardened insert defines a non-round opening therethrough, the yarn passing through the top insert opening.

9. The ball tension device of claim 8 wherein the configuration of the top insert opening is similar to the configuration of the non-round opening in the cap.

10. The ball tension device of claim 7 and an interior flange formed in the cap about the cap opening, the top hardened insert being in contact with the flange to secure the top hardened insert to the cap.

11. In a ball tension device with improved yarn threading means of the type having a vertical body defining a hollow ball chamber of interior diameter suitable to loosely hold a plurality of balls, the ball chamber terminating upwardly in an open top and downwardly in a bottom ceramic insert, the improvement comprising a cap overfitting the top of the ball chamber, the cap being provided with a cap opening having two dimensions;

the cap opening having one dimension which is substantially equal to the diameter of the ball chamber; and wherein the balls are of preselected diameter that is less than the diameter of said ball chamber and wherein the other dimension of the cap opening is less than the diameter of any balls.

12. The ball tension device of claim 11 and a non-round hardened insert secured to the cap about the cap opening.

13. The ball tension device of claim 12 wherein the non-round insert is provided with a yarn opening therethrough, the yarn opening having a length that is substantially equal to the interior diameter of the ball chamber at the top thereof.

14. The ball tension device of claim 13 wherein an interior flange is formed in the cap about the said cap opening, the non-round insert being seated upon the interior flange.

* * * * *